US007059502B2

(12) United States Patent
Johnson

(10) Patent No.: US 7,059,502 B2
(45) Date of Patent: Jun. 13, 2006

(54) SLING FOR A SHOULDER WEAPON

(76) Inventor: David A. Johnson, P.O. Box 12517, Salem, OR (US) 97309

( * ) Notice: Subject to any disclaimer, the term of this patent is extended or adjusted under 35 U.S.C. 154(b) by 202 days.

(21) Appl. No.: 10/392,463

(22) Filed: Mar. 18, 2003

(65) Prior Publication Data

US 2004/0182894 A1 Sep. 23, 2004

(51) Int. Cl.
*F41C 23/02* (2006.01)

(52) U.S. Cl. ..... 224/150; 224/913

(58) Field of Classification Search ..... 224/150, 224/913

See application file for complete search history.

(56) References Cited

U.S. PATENT DOCUMENTS 2,357,363 A * 9/1944 Smith et al. ..... 224/150
2,779,521 A * 1/1957 Granberg ..... 224/150
4,361,258 A * 11/1982 Clark ..... 224/150
4,823,998 A * 4/1989 Johnson ..... 224/150
5,370,286 A * 12/1994 Newman ..... 224/578
5,660,312 A * 8/1997 Suzuki ..... 224/627
5,810,219 A * 9/1998 Rosenfield ..... 224/150
6,520,390 B1 * 2/2003 Verdugo et al. ..... 224/150
6,681,973 B1 * 1/2004 Crumrine ..... 224/637

OTHER PUBLICATIONS

Safety Systems Corporation, "Tactical Weapons Sling", 1990.
Safety Systems Corporation, "Instructions for M-16 Tactical Weapon Sling" and "Instructions for Tactical Weapon Sling Attachments CAR/SMG," 1990.
Boonie Packer Products, "BP-53 AR15-M16 Carbine Sling Installation," at least as early as 2002.

* cited by examiner

*Primary Examiner*—Tri M. Mai
(74) *Attorney, Agent, or Firm*—Chernoff, Vilhauer, McClung & Stenzel, LLP

(57) ABSTRACT

A sling for a shoulder weapon, such as a military assault rifle or carbine, in which the effective length of the sling can be extended quickly and quietly and then easily and quietly retracted to the original length. A quick release plate and an engagement member cooperate to hold a loop of strap material to provide the shorter configuration of the sling, and the quick release plate can pass over the engagement member to lengthen the sling when the quick release plate is turned to a position perpendicular to the length of the sling. The opposite ends of the sling can be attached to a weapon using secure, quiet fittings.

7 Claims, 12 Drawing Sheets

SLING FOR A SHOULDER WEAPON

BACKGROUND OF THE INVENTION

The present invention relates to slings for shoulder weapons, and particularly for military tactical weapons.

It is usually desirable to use a sling to carry a military shoulder weapon so it is quickly available and ready for use while leaving a soldier's hands free for performing other tasks when the weapon is not actually in use.

Many military rifle slings have been known in the past, and some of them have been designed to be lengthened readily from a length best adapted for carrying the weapon to a length best for using the weapon while in a particular position. Usually, a sling permits a weapon to be raised to a soldier's preferred shoulder. Depending on the locality of a target with respect to a structure behind which a soldier can be partially concealed, however, in some cases it is necessary for a soldier to shoot with the weapon at his opposite, non-preferred shoulder. Preferably, the soldier should be able to move the weapon to the non-preferred shoulder without having to disengage the sling from his body, but to do so may require that the sling be lengthened.

Some previously available slings for shoulder weapons have included a first or inner strap extending along one side or the other of the weapon from its buttstock to its forestock. A second strap that passes around the soldier's body, usually over one shoulder, is fastened to the first strap near the forestock of the weapon, but with its front end releasable to slide rearward along the first strap to give the soldier the additional freedom required to raise the weapon to the non-preferred shoulder. In such slings the first strap, extending closely alongside the weapon, can interfere with operation of the weapon, and the second strap portion of the sling, when released to slide along the inner strap, extends more closely around the body of the soldier, increasing the difficulty of removing the weapon quickly should that be required. Previously available devices for releasing and reengaging the sliding end of the second strap have been less than desirably easy to operate, particularly for a soldier wearing gloves.

Arrangements for attaching the rear end of a sling to a rifle buttstock at a location separated from an installed sling swivel have been cumbersome and complicated.

One such previously available sling is a tactical weapons sling available from Safety Systems Corporation of Hanover Park, Ill. That sling includes an enlargement at one point along a first or inner sling strap, and a quick release plate is ordinarily held by sling strap tension in an orientation in which the quick release plate cannot move along the inner sling strap past the enlargement.

A carbine sling available from Boonie Packer Products division of JFS, Inc. of Salem, Oreg., utilizes a piece of flexible strapping which becomes doubled-over and jams behind a slide to keep a front end of a sling strap in the usual configuration. The doubled loop of strapping must be pulled forward from the slide to release the movable front end to slide along the inner sling strap, but this requires a significant pull toward the front end of the weapon, causing a slight delay before the sliding front end of the sling can be moved rearwardly along the inner sling strap.

SUMMARY OF THE INVENTION

The present invention overcomes the aforementioned shortcomings of previously available slings for military shoulder weapons by providing a sling of which a portion is in the form of a strap extending through a strap slide aperture and then doubling back along its own length for at least some distance to a position where its traveling end is held releasably by engagement of a quick release plate with an engagement member attached to a main portion of the strap. The quick release plate is normally held generally parallel with the main portion of the strap by tension in the sling. Reorientation of the quick release plate to a position generally perpendicular to the main portion of the sling allows a part of the engagement member to flex and thus release the quick release plate from the engagement member, allowing the quick release plate to slide along the sling strap toward the strap slide aperture and allowing the doubled portion of the sling strap to move through and then away from the slide aperture, thus increasing the effective length of the sling.

In one preferred embodiment of the invention, the engagement member is a length of webbing material attached to the main portion of the sling strap with a flexible free end tab directed away from the doubled portion of the sling strap.

As another aspect of the invention, a mounting loop for fastening a rear end of a sling to a shoulder weapon includes a non-slipping fastening arrangement.

The foregoing and other objectives, features and advantages of the invention will be more readily understood upon consideration of the following detailed description of the invention, taken in conjunction with the accompanying drawings.

DETAILED DESCRIPTION OF THE PREFERRED EMBODIMENTS

Figure 1:
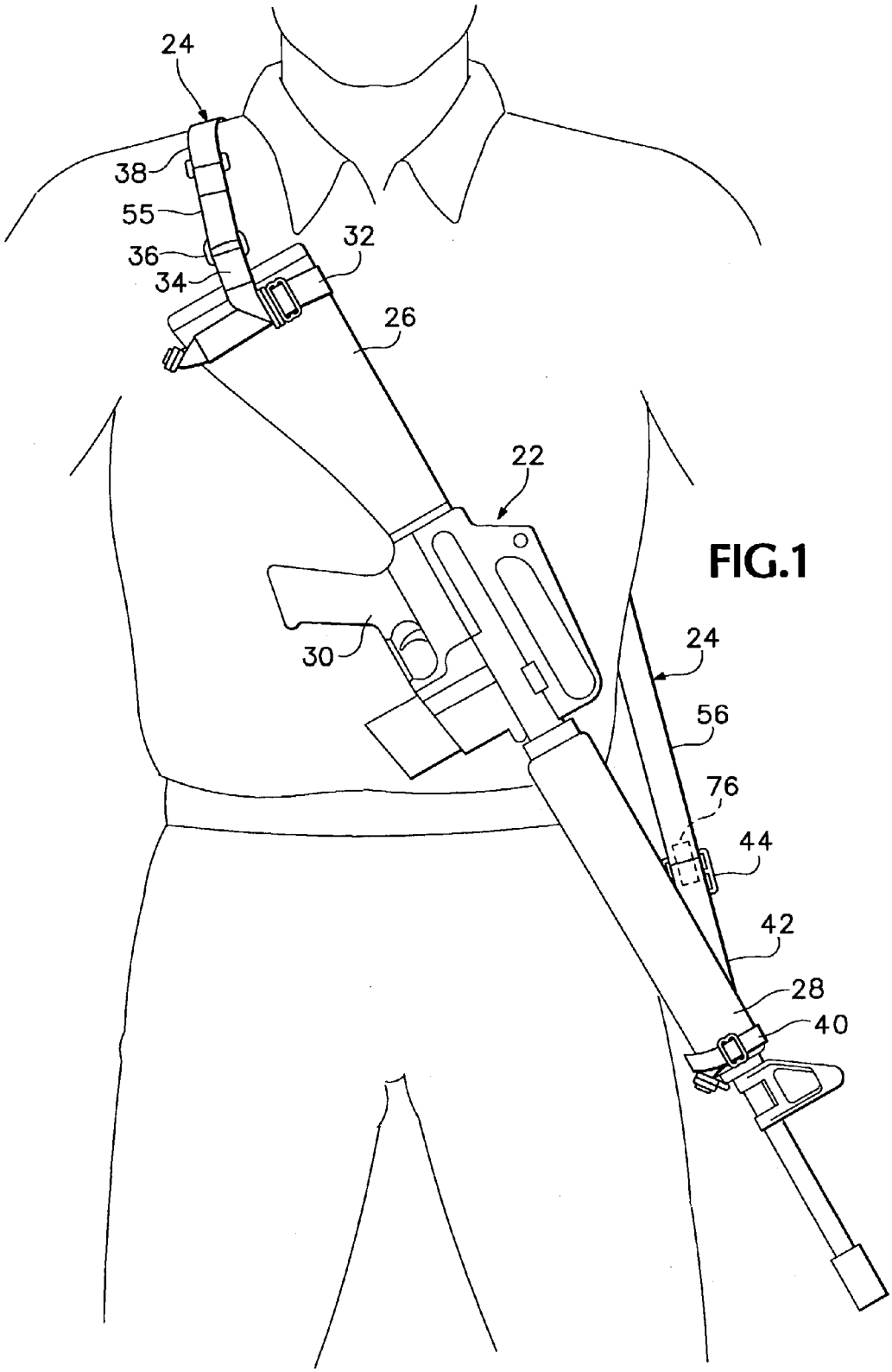
FIG. 1 is a view of the torso of a soldier carrying an automatic rifle equipped with a sling which is one preferred embodiment of the present invention, with the automatic rifle in a high carry position and the sling extending over the soldier's right shoulder.

Referring now to the drawings which form a part of the disclosure herein, in FIG. 1 a military shoulder weapon, in this case an automatic rifle 22, is carried by a soldier, supported by a sling 24 attached to the automatic rifle 22 and arranged to extend from the buttstock 26 over the soldier's right shoulder, around his back, and to the forestock 28, supporting the automatic rifle 22 in a high carry position which enables a right-handed soldier to raise the automatic rifle 22 quickly to his right shoulder and there to grip the pistol grip 30 with his right hand and support the forestock 28 with his left hand. A person using such a sling can thus raise the automatic rifle 22 quickly to his preferred shoulder in the usual shooting position while the sling 24 remains in its normal configuration arranged to support the automatic rifle 22 in the high carry position. A buttstock sling mounting loop assembly 32 includes a short attachment strap 34 to which a D-ring 36 is fastened to receive the rear end 38 of the sling 24. The rear end 38 of the sling 24 is thus attached to the right side of the buttstock 26, holding it close to the soldier's chest, as shown in FIG. 1.

A front attachment loop assembly 40 attaches the front end 42 of the sling 24 to the forestock 28 of the automatic rifle 22. A quick release plate 44 may be utilized as will be explained presently to extend the length of the sling 24 quickly and silently to an increased length.

Figure 2:
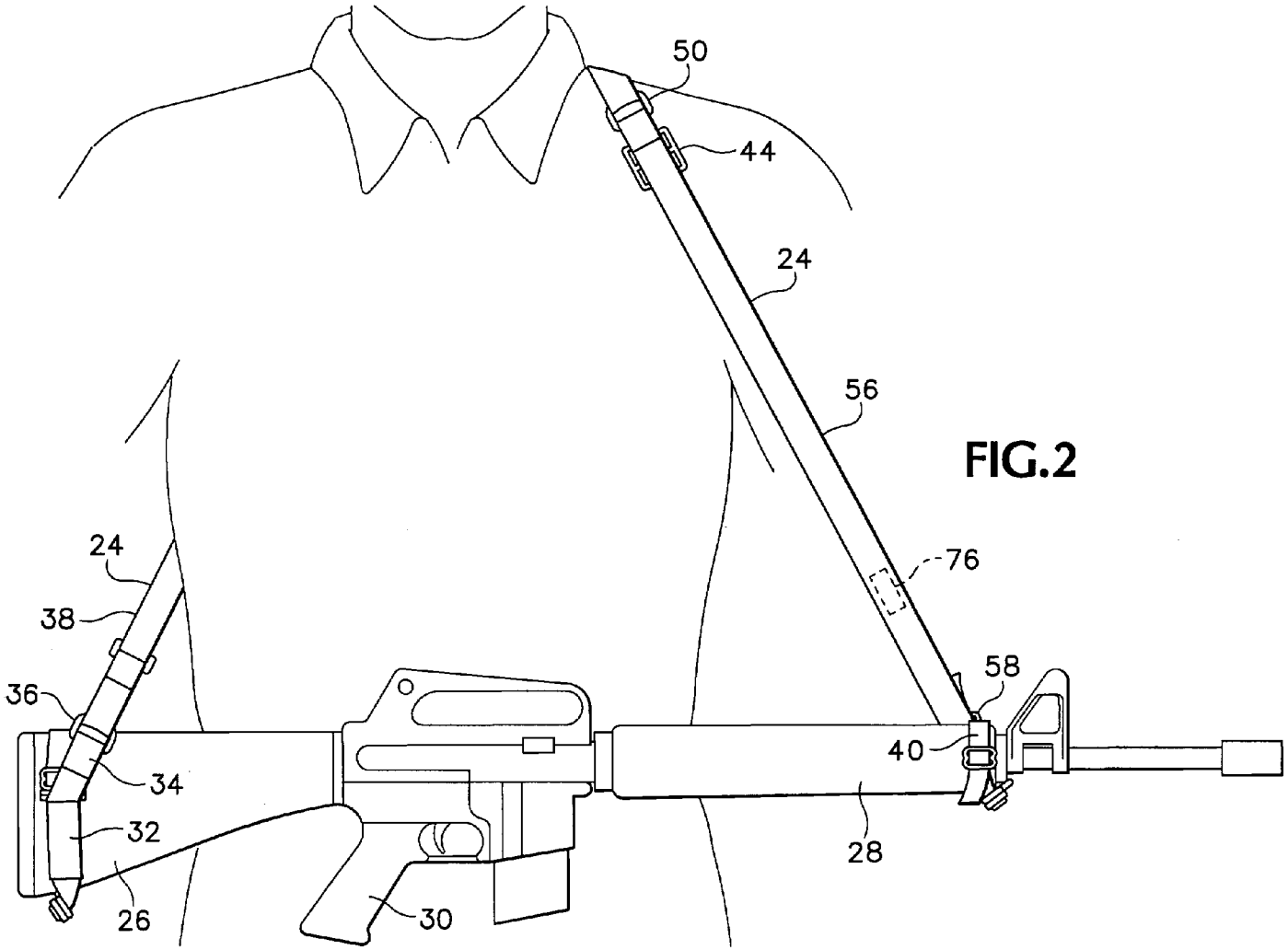
FIG. 2 is a view of the torso of a soldier carrying an automatic rifle equipped with the sling shown in FIG. 1, but with the rifle in a horizontal carry position and the sling extending over the soldier's left shoulder.

In FIG. 2, the automatic rifle 22 is shown as it would be carried by a right-handed soldier, in a horizontal carry position, with the sling 24 extending from the buttstock 26, passing under the soldier's right arm, around his back, and down over his left shoulder to the forestock 28. The quick release plate 44 is further from the front attachment loop assembly 40 than its position as shown in FIG. 1, as will be explained in greater detail presently. The extended length of the sling 24 is great enough to permit the automatic rifle to be raised easily to either shoulder.

In some situations, it becomes desirable for a soldier to shoot a shoulder weapon such as the automatic rifle 22 from his non-preferred shoulder. Thus, in FIG. 3, a soldier is holding the automatic rifle 22 to his left shoulder, although the sling 24 is arranged to extend from the buttstock 26 over the soldier's right shoulder as shown in FIG. 1, where the automatic rifle 22 is supported in the high carry position used by a right-handed shooter.

Figure 3:
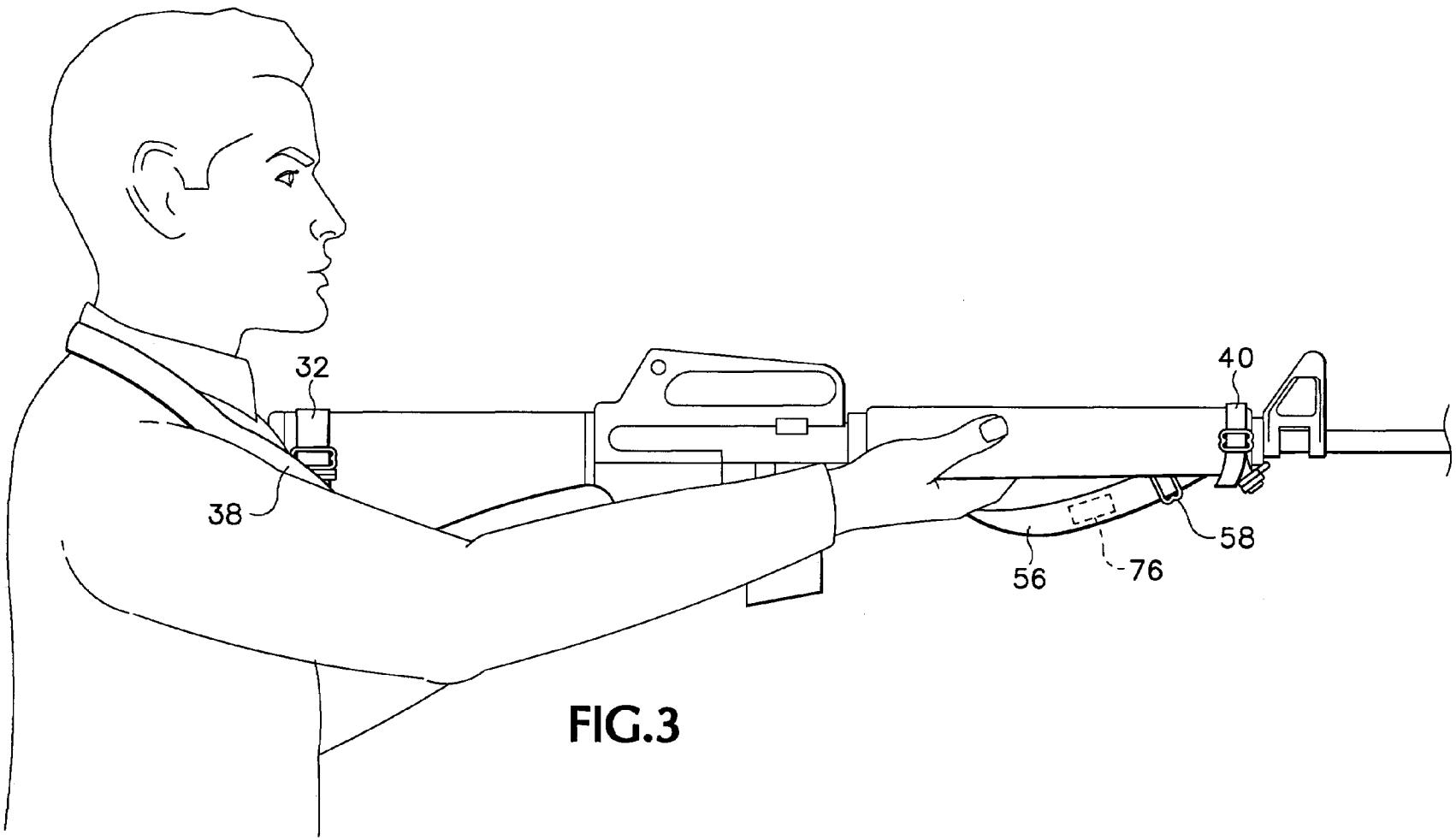
FIG. 3 is a side view of the torso of a right-handed soldier holding an automatic rifle at his left shoulder, with the sling shown in FIGS. 1 and 2 in its extended configuration.

The sling 24, used in its ordinary configuration for a high carry as shown in FIG. 1, is too short to permit the buttstock 26 to be placed readily at a right handed shooter's left shoulder as shown in FIG. 3. However, the length of the sling 24 can quickly and quietly be extended to that shown in FIG. 2, to permit a right-handed soldier to quickly place the automatic rifle on his left shoulder as shown in FIG. 3 in order, for example, to shoot around the left end of a protecting wall without exposing his body completely beyond the wall.

Figure 4:
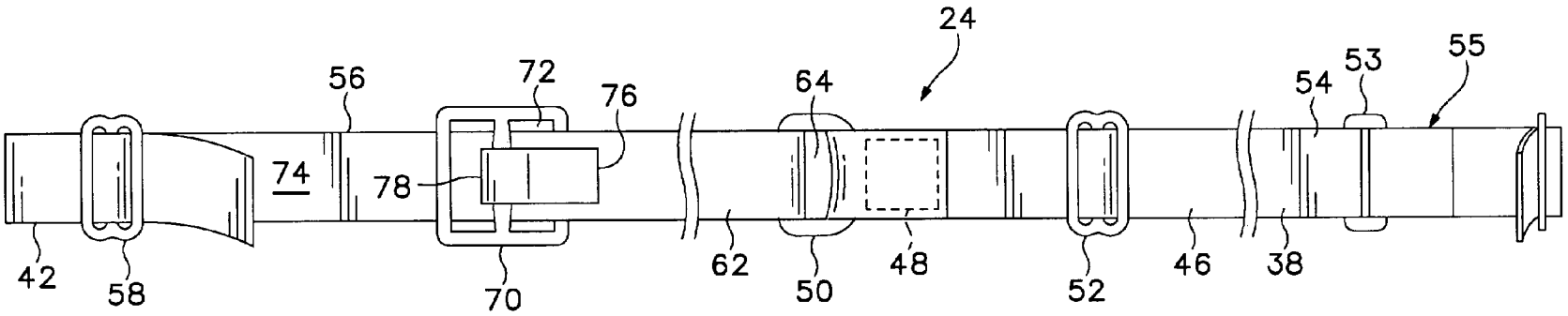
FIG. 4 is a plan view of the sling shown in FIGS. 1–3 in its normal configuration.
Figure 5:
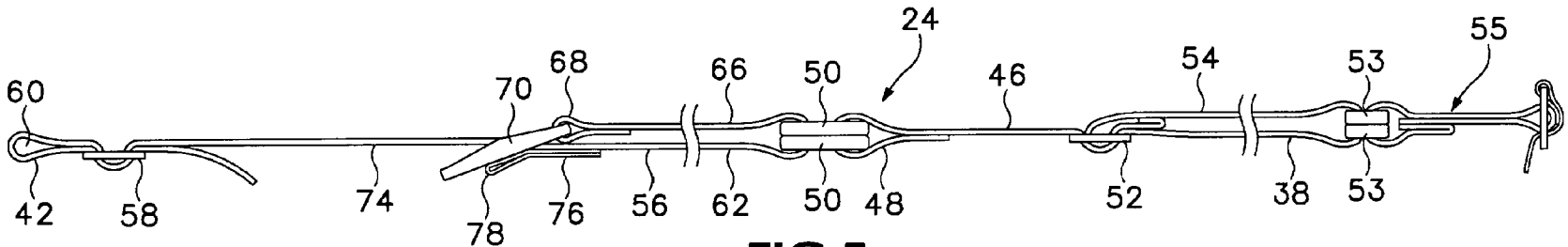
FIG. 5 is a side elevational view of the sling shown in FIG. 4.

Referring to FIGS. 4 and 5, the sling 24 is shown shortened by omission of parts of the longer strap portions, in order to more clearly illustrate the way in which its parts are interconnected. At the rear end 38, an elongate rear strap portion 46 may be of a suitable flexible webbing such as a well-known flat, tubular, nylon webbing that is about 1 inch wide and 0.08 inch thick. A front end of the rear strap portion 46 is sewn or otherwise fastened to form a loop 48 engaging the curved side of a pair of plastic D-rings 50. The D-rings 50 are provided as a pair to ensure ample strength for unusual situations although one is sufficient for normal loads. The rear strap portion 46 extends rearwardly from the D-rings 50 through a fastener such as a metal tribar slide 52 to form an elongate rear end adjustable loop 54. The rear end adjustable loop 54 passes through a connector such as a pair of loops 53 which are part of a sling attachment stopper device 55 that will be explained subsequently. The adjustable loop 54 permits the overall length of the sling 24 to be adjusted to fit the particular weapon and soldier and to accommodate possible different ways of attaching the rear end 38 of the sling 24 to the buttstock of a weapon, or of attaching the front end 42 of the sling 24 to a forward portion of a weapon.

Extension of the Sling

Extending forward from the D-rings 50 is an elongate quickly extendible front strap portion 56 of the sling 24. The front strap portion 56 may be of webbing material similar to that of the rear strap portion 46 and is held by a metal front tribar slide 58 or other suitable fastener to form an adjustable fastening loop 60 by which the front end 42 of the sling 24 may be attached to the front attachment loop assembly 40 or otherwise fastened to the forward portion of a weapon such as the automatic rifle 22.

A main portion 62 of the quickly extendible front strap portion 56 extends rearwardly from the front end 42 which is fixed to the forward part of a weapon, and passes through the D-rings 50. The opening within the D-rings 50 acts as a strap slide aperture 64 through which the front strap portion 56 can slide easily around the straight side of the D-rings 50.

An extension portion 66 of the extendible front strap portion 56 is doubled back toward the front end 42, alongside the main portion 62, and has a traveling end 68 fastened to a quick release plate 70, as by being sewn to form a loop.

It will be understood that the traveling end 68 of the extension portion of the strap could be fastened to the quick release plate 70 by other means, as by being molded into a quick release plate 70 of suitable plastic construction. In the present embodiment, however, a readily available tribar slide of molded plastic construction is used as the quick release plate 70, and the traveling end 68 is fastened to one of the side bars of the tribar slide, as shown in FIGS. 4 and 5.

The quick release plate 70 defines a slot 72, between its center bar and the side bar to which the traveling end 68 of the front strap portion 56 is attached, and the main portion 62 extends through the slot 72 alongside the loop in the traveling end 68, on a side of the front strap portion 56 which ordinarily faces toward the forestock of a weapon, such as the automatic rifle 22, to which the sling 24 is connected.

On an opposite or outer side 74 of the extendible front strap portion 56, an engagement member 76 is securely attached to the main portion 62. The engagement member 76 has a flexible free front flap portion 78 that extends away from the strap slide aperture 64 and toward the front end 42 of the sling 24. The engagement member 76 is of strong resiliently flexible material, and may preferably be of a tightly woven flat webbing material thinner than the webbing material of the front strap portion 56 but less easily flexible. The webbing is doubled back on itself to provide a loop acting as the front flap 78, although such a loop is not necessary, and the engagement member 76 could be made of another material if desired, so long as it is not excessively flexible. The engagement member 76 is securely fastened to the main portion 62, as by being sewn thereto.

Figure 6:
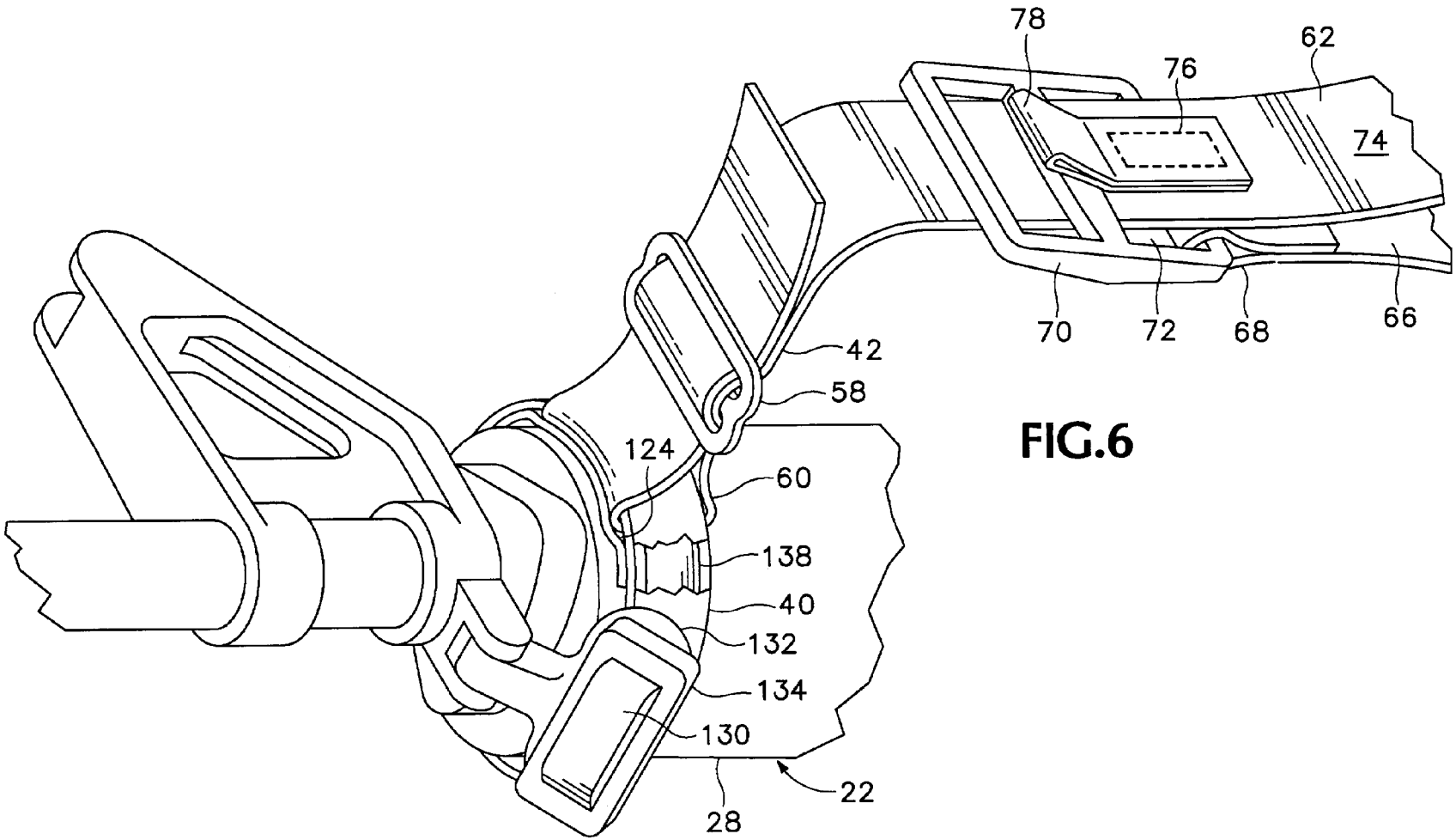
FIG. 6 is an isometric view of the front end of the automatic rifle and sling shown in FIGS. 1–3, at an enlarged scale, showing a front attachment loop assembly connecting the front end of the sling to the forestock of the automatic rifle.
Figures 7, 8, 9:
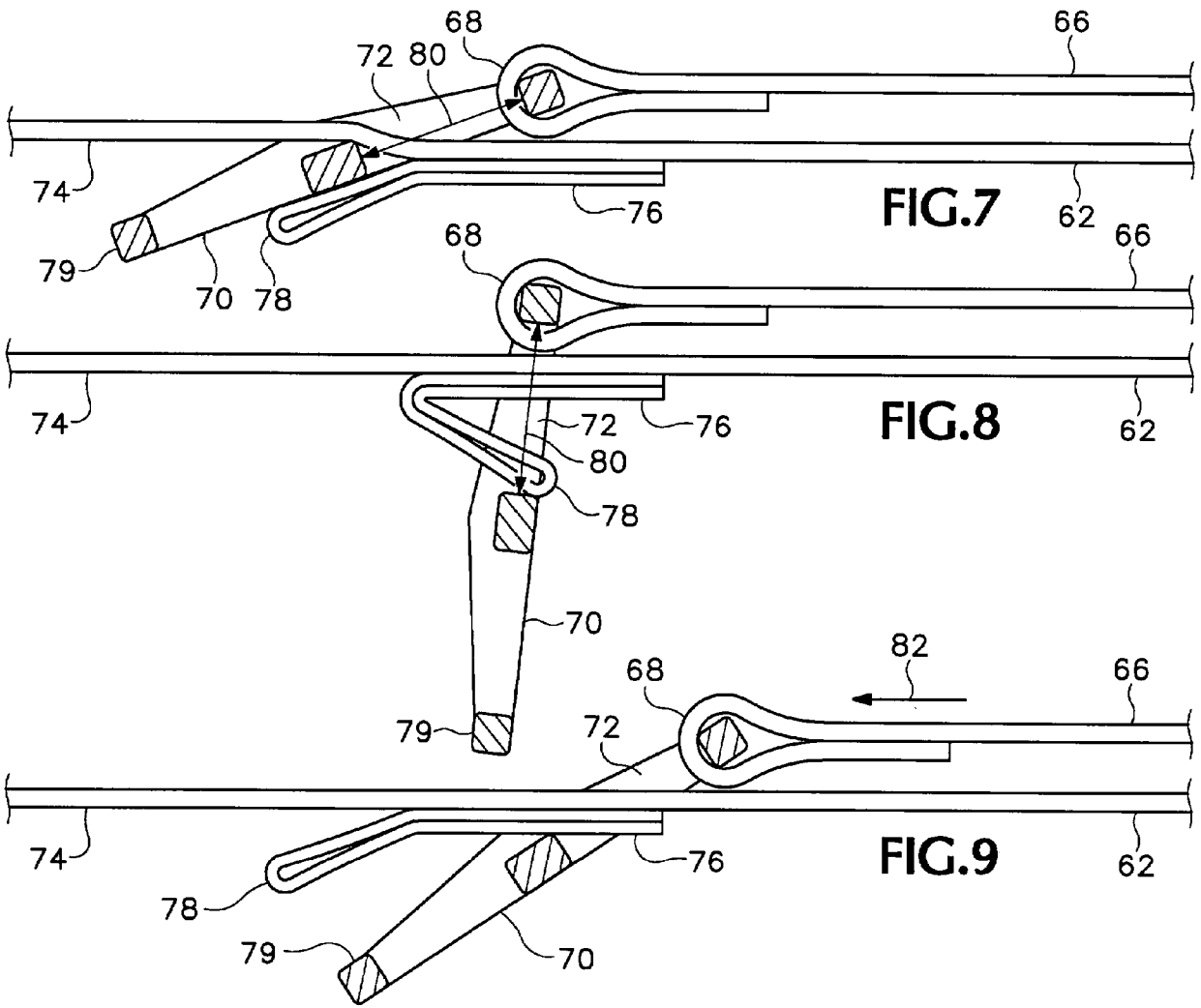
FIG. 7 is a sectional view of a detail of the sling shown in FIG. 1 including the quick release plate, taken along line 7—7 in FIG. 4.
FIG. 8 is a view similar to that of FIG. 7, but with the quick release plate moved to an orientation perpendicular to the main portion of the sling strap.
FIG. 9 is a view similar to FIG. 7 showing the quick release plate adjacent the engagement member but disengaged from it and free to move along the main portion of the sling strap.

As may also be seen in FIGS. 6 and 7, a front portion 79 of the quick release plate 70 adjacent the slot 72 rests between the front flap 78 and the outer side 74 of the main portion 62 of the strap. When the sling 24 is in use, with tension in the extension portion 66 and the main portion 62, the quick release plate 70 lies alongside and generally parallel with the main portion 62 in which it causes a small bend, as shown in FIG. 7. The front flap 78 is thus on one side of the front portion 79 of the quick release plate 70, while the outer side 74 of the main portion 62 is on the other side, and the engagement member 76 thus prevents the quick release plate 70 from moving along the main portion 62 away from the front end 42 of the sling 24. The width 80 of the slot 72 is small enough that tension in the extension part 66 keeps the quick release plate 70 oriented generally parallel with the main portion 62, with relatively little force directed toward the front flap 78, so that movement of the quick release plate 70 along the main portion 62 is effectively resisted by the engagement member 76.

The front strap portion 56 of the sling 24 can be quickly extended in length, however, by releasing the quick release plate 70 from engagement with the engagement member 76. This is accomplished by grasping the front portion 79 of the quick release plate and moving it from closely alongside the main portion 62 to a position approaching perpendicularity with the main portion 62, as shown in FIG. 8. This movement of the quick release plate 70 presents the slot 72 more widely open toward the front flap 78, so the quick release plate 70 can flex the front flap 78 toward the attached portion of the engagement member 76 and thus toward the strap slide aperture 64 in the D-rings 50. This allows the quick release plate 70 to move along the main portion 62 away from the front end 42 and toward the strap slide aperture 64, with the extension portion 66 then sliding through the strap slide aperture 64 of the D-rings 50 to increase the effective length of the quickly extendible front strap portion 56. The length of the extension portion 66 is effectively added to the length of the main portion 62 by allowing the quick release plate 70 to slide back to the D-rings 50. The front portion 79 of the quick release plate 70 can easily be grasped by a soldier, even when wearing gloves, to rotate it to the position shown in FIG. 8 and thus allow the quickly extendible front strap portion 56 to be extended.

In order to restore the length of the sling 24 to the shorter ordinary configuration allowing the automatic rifle 22 to be carried in the high carry position shown in FIG. 1, it is necessary to move the traveling end 68 and the quick release plate 70 along the extension portion 66 of the strap, pulling it back through the strap slide aperture 64, and then along the main portion 62 to the engagement member 76, in the direction indicated by the arrow 82 in FIG. 9. When the slot 72 of the quick release plate 70 has been moved past the entire engagement member 76, including the front flap 78, tension applied to the quick release plate 70 through the traveling end 68 of the extension portion 66 can draw the quick release plate 70 once more into the position shown in FIG. 7, to retain the traveling end 68 of the extension portion 66 adjacent the engagement member 76, with the sling thus in its shorter ordinary length configuration.

Figure 10:
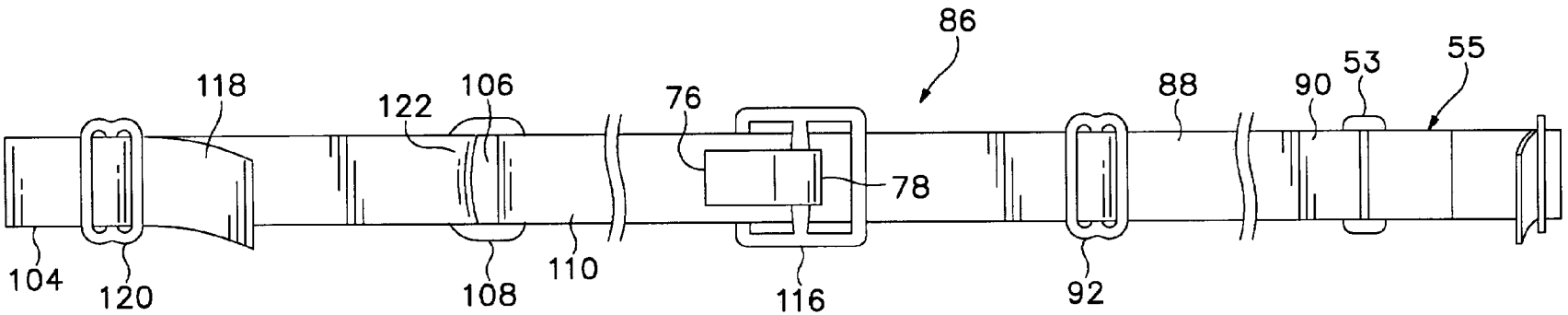
FIG. 10 is a view similar to FIG. 4, showing a sling which is an alternative embodiment of the invention, in its normal configuration.
Figure 11:
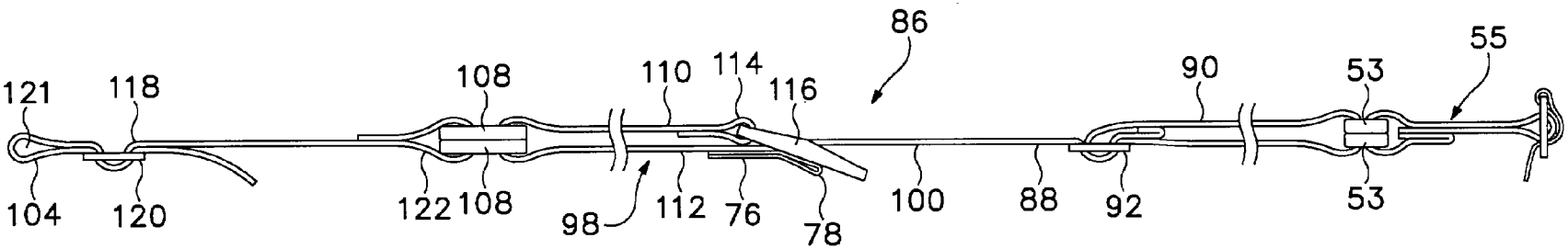
FIG. 11 is a side elevational view of the sling shown in FIG. 10.

A sling 86 shown in FIGS. 10 and 11 is an alternative to the sling 24 and may be of the same materials and include similar components, but is arranged slightly differently. At a rear end 87 of the sling 86, a rear strap portion 88 has its rear end fashioned into an adjustable loop 90 held by a tribar slide 92 corresponding with the tribar slide 52 of the sling 24. The adjustable loop 90 extends through linking loops 94 of a sling attachment stopper device 55, although it could otherwise be engaged with a buttstock of a weapon with which the sling 86 is to be used.

A quickly extendible front strap portion 98 of the sling 86 is similar to the quickly extendible front strap portion 56 in the sling 24, but is oriented in the opposite direction. A fixed first end of its main portion 100 thus is an integral extension of the rear strap portion 88, and an engagement member 76 has its front flap 78 directed toward the rear strap portion 88. The main portion 100 extends forward from the rear strap portion 88 toward the front end 104 of the sling 86, and passes slidably through a strap slide aperture 106 defined by a pair of D-rings 108 which may be similar to the D-rings 50. An extension portion 110 doubles back along the main portion 100 toward the rear strap portion 88, along the inner side of the main portion 100, the side that faces toward the weapon when the sling 86 is in place. As in the sling 24, the engagement member 76 is located on the opposite, outer side 112 of the main portion 100, facing away from a weapon on which the sling 86 is installed. A traveling end 114 of the extension portion 110 is attached securely to a quick release plate 116 which may be identical to the quick release plate 70 described with respect to the sling 24.

Operation of the quickly extendible front strap portion 98 to extend the length of the sling 86 is the same as that described above with respect to the sling 24 and shown in FIGS. 7, 8, and 9, except that extension of the sling 86 is accomplished by releasing the quick release plate 116 to move forward from the engagement member 76 toward the front end 104 of the sling 86.

A short front end sling mounting strap 118 has its free end adjustably and releasably held by a tribar slide 120, forming an adjustable fastening loop 121 to permit attachment of the front end 104 of the sling 86 to a forward portion of a weapon. The other end of the front end sling mounting strap 118 is fastened securely to the curved side of the pair of D-rings 108, as by being sewn to itself in the form of a loop 122, to support the D-rings 108 so that the quickly extendible front strap portion 98 can slide freely through the strap slide aperture 106 and around the straight side of the D-rings 108.

Front End Attachment

Figure 12:
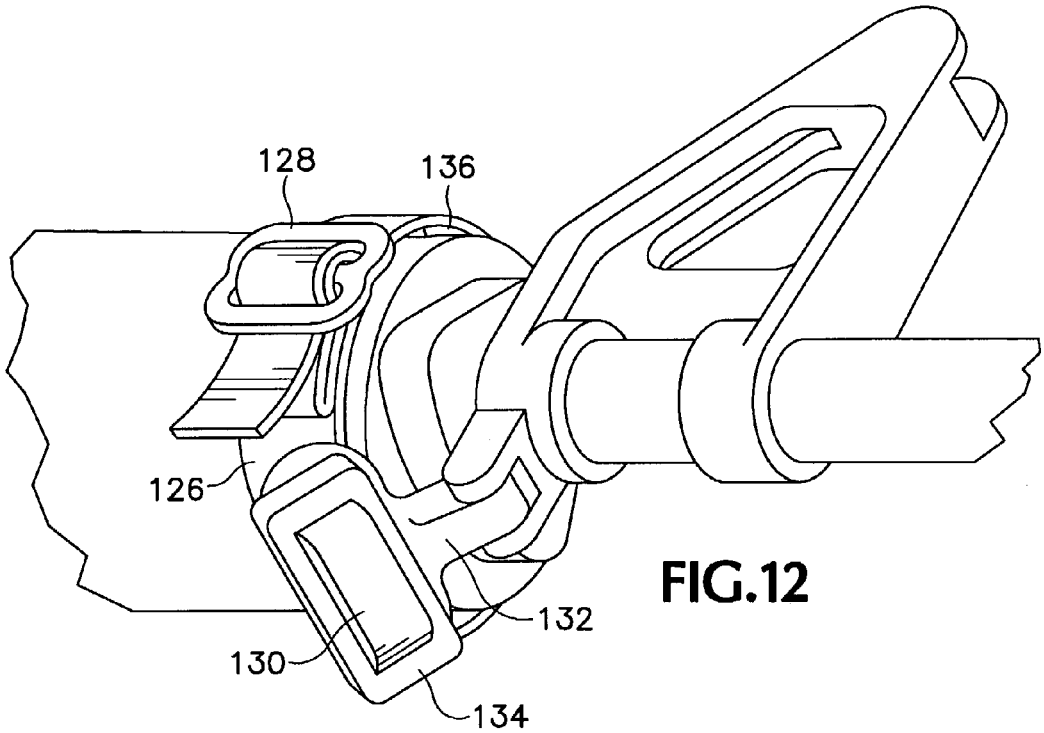
FIG. 12 is an isometric view taken from the lower right front, of the front attachment loop assembly shown in FIG. 6 fastened to a sling swivel beneath the front sight of the automatic rifle shown in FIGS. 1–3.
Figure 13:
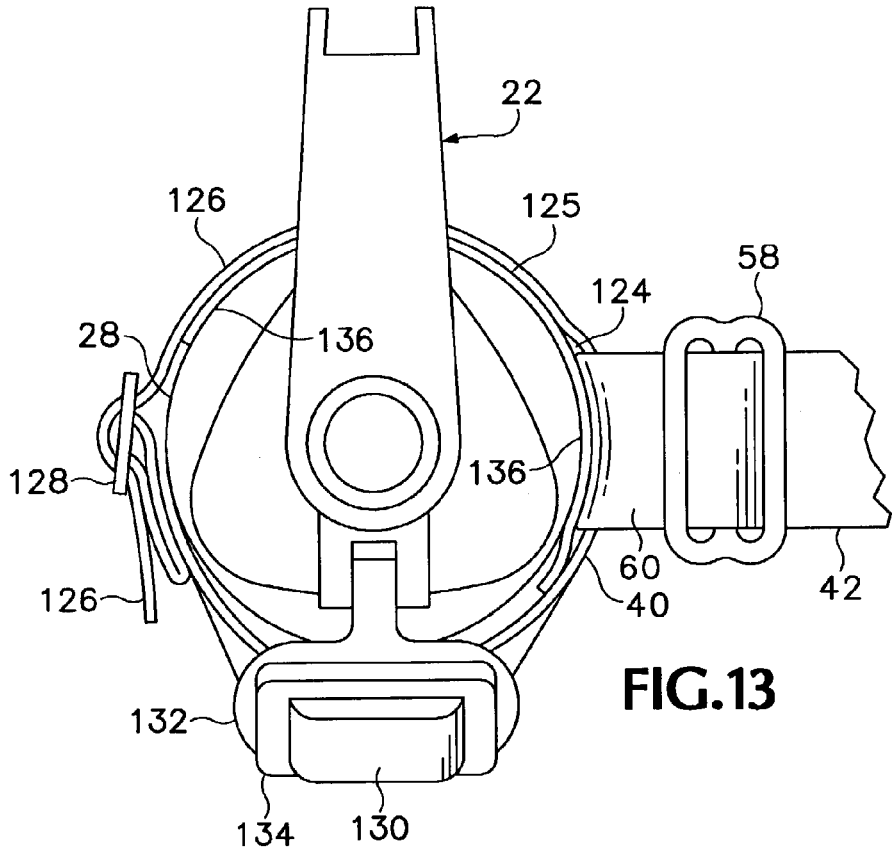
FIG. 13 is a front end elevational view of the automatic rifle shown in FIGS. 1–3, showing the front attachment loop arrangement shown in FIG. 12, with the front end of the sling attached thereto as shown in FIG. 6.

As shown in FIGS. 6, 12, and 13, the front end 42 of the sling 24 is attached to the forestock 28 by engagement of the adjustable loop 60 in a sling receiving aperture 124 defined by the front end attachment loop assembly 40. The front end attachment loop assembly 40 includes a first, or outer, flexible elongate tension carrying member such as a strap portion 126 whose opposite ends are interconnected with each other by a releasable and adjustable fastener such as a tribar slide 128, so that the strap member 126 fits snugly about the forestock 28 or other forward part of a weapon to which the sling 24 or sling 86 is to be attached. A small bight 130 of the outer elongate flexible strap 126 extends through the eye of a sling swivel 132, where it is held in place by a slotted stopper plate 134 through whose slots the outer strap 126 extends, to keep the front end attachment loop assembly 40 in a desired position with respect to the sling swivel 132. The stopper plate 134 is small enough to pass through the eye of the sling swivel 132 lengthwise, but once subjected to tension in the outer strap 126, the stopper plate 134 aligns itself with the sling swivel and holds the bight 130 within the eye of the sling swivel 132, while the outer strap 126 is held by the tribar slide 128. An inner strap member 136 extends along a part of the outer strap 126, between it and the forestock 28. The inner strap 136 is attached to the outer strap 126 at two locations spaced apart by a great enough distance to define a sling receiving aperture 124 with a preferred length in the range of one inch to two inches, to receive and hold the strap 126. The position of the outer strap 126 in the stopper plate 134 can be adjusted to place the aperture 124 at either side of the forestock 28, as shown in FIGS. 6 and 13, or to adjust it further toward the top of the forestock 28 if desired.

The inner strap 136 preferably extends beyond the aperture 124 and is fastened to the outer strap 126 to form a similar second strap receiving aperture 125. This arrangement may be particularly useful for a shoulder weapon having a sling swivel on a side of its forestock rather than the bottom of its barrel. With a bight 130 of the strap 126 attached to such a sling swivel the aperture 124 could then be on the top of the forestock and the aperture 125 would be about 180° away around the forestock, opposite the sling swivel. Thus the sling 24 could be advantageously used by a soldier preferring to carry and shoot a right-handed weapon left-handedly.

In one preferred embodiment of the attachment loop assembly 40, the outer strap 126 may be of a tubular webbing material, such as a readily available one-half inch wide tubular nylon webbing, and a ribbon 138 of a strong heat-resistant material, such as a half inch wide woven tape of Kevlar polyamide aramid fabric, is preferably housed as a core within the webbing material. Such a material is desired as a core within the outer strap 126 in order to preserve the integrity of the connection of the sling 24 to the forestock of a military weapon which may become so hot with continued firing of the weapon that a front attachment loop assembly 40 made of a material with a low melting point might fail just when it is most needed. While the problem of high temperature has been answered in the past by use of metal sling fittings, such fittings often rattle with a sound which might easily be heard by an adversary, while the front attachment loop assembly 40, since it is of largely fabric construction, provides a nearly silent attachment of a sling to a weapon.

Figure 14:
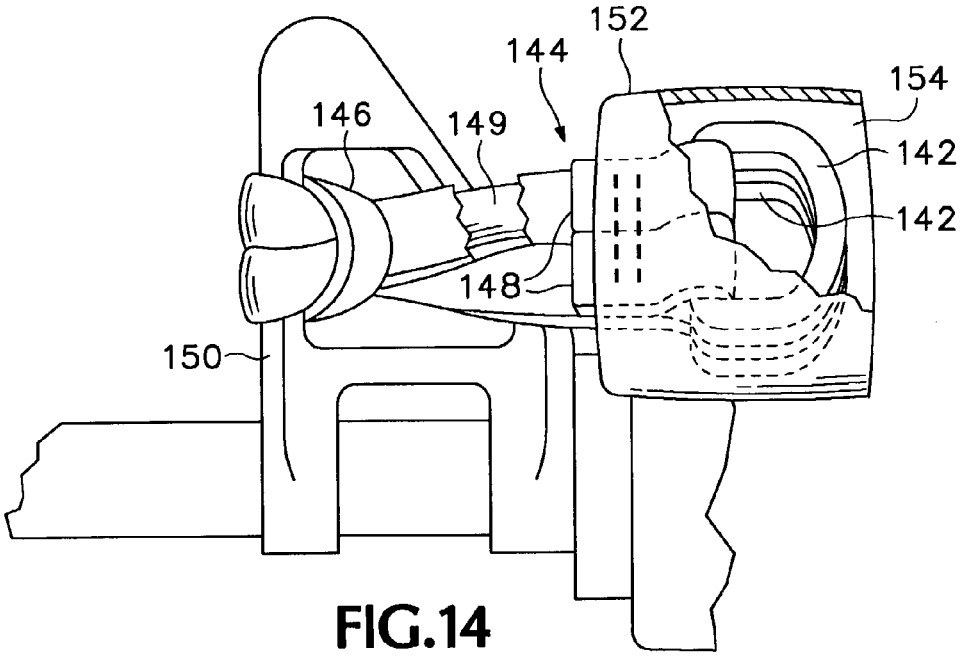
FIG. 14 is a side elevational view of a portion of a military rifle, showing a sling attachment device fastened to the front sight of the rifle.

A sling attachment device 144 for military weapons which do not include a sling swivel at their forward ends is shown in FIG. 14. The loop 60 at the front end 42 of the sling 24, or the loop 121 at the front end 104 of the sling 86, can be fastened around a pair of D-rings 142 included in the sling attachment device 144, in which an elongate flexible tension carrying member, such as a cord or narrow strap 146, has at least one end 148 securely fastened to a D-ring or a pair of D-rings 142 so that the strap 146 can be used to fasten the D-ring or D-rings 142 to a desired part of a weapon. Like the strap 126 of the attachment loop assembly 40, the strap 146 preferably has a core 149 of a strong heat-resistant material such as Kevlar polyamide aramid.

Preferably, both of the opposite ends 148 of the strap 146 are securely fastened to the D-rings 142, so that the strap 146 forms a loop which can be hitched securely around the desired part of a weapon to which a sling is to be attached, such as the vertical front part 150 of a front sight of the automatic rifle 22. In order to avoid unnecessary and undesirable noise caused by the connection of the sling to a weapon, a silencing hood 152 is provided around the D-rings 142, attached, for example, to the strap 146. Preferably, the silencing hood 152 is a short, thin-walled tube of a soft or resiliently flexible material capable of absorbing an impact and deadening the sound that would otherwise be made. For example, a short length of thin-walled rubber tubing material similar to bicycle tire inner tube material is satisfactory as the silencing hood 152, although leather or fabric could also be used. At the end of the tube opposite its attachment to the strap 146, an open mouth 154 permits the adjustable sling strap loop 60 to be inserted and threaded through the D-rings 142 to attach the sling 24 to the attachment device 144.

Rear End Attachment

Figure 15:
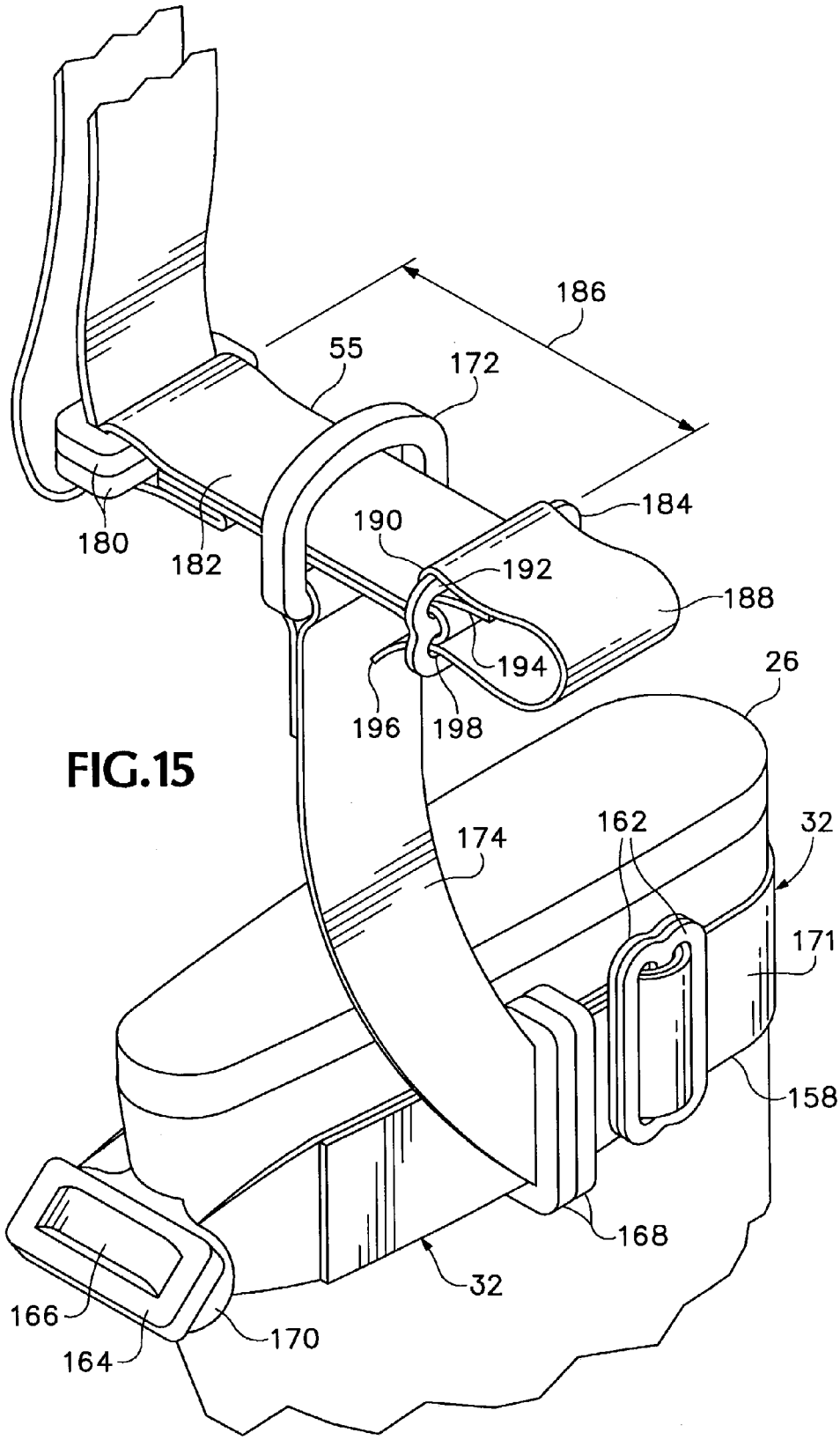
FIG. 15 is an isometric view of the rear end of the buttstock of a rifle such as that shown in FIGS. 1–3, showing a sling mounting loop assembly mounted on the buttstock and showing the connection of the sling to it.
Figure 16:
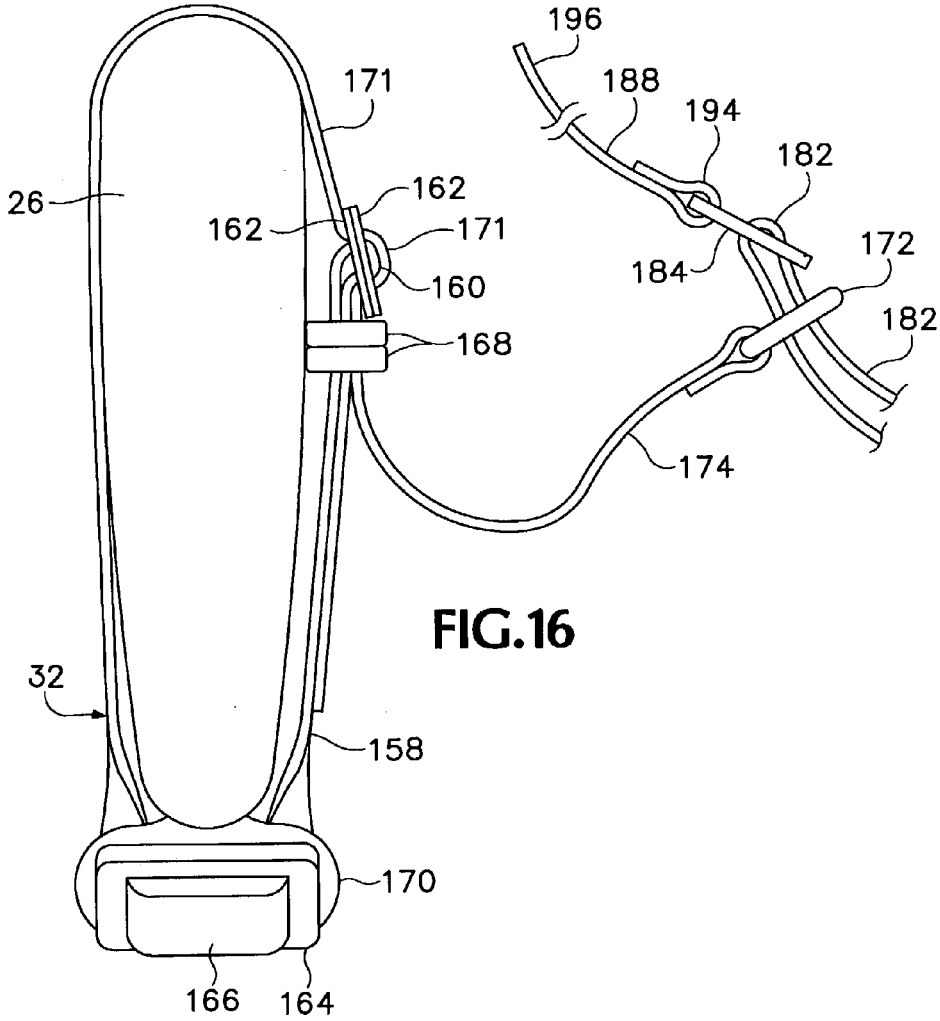
FIG. 16 is an end elevational view of the buttstock and the sling mounting loop assembly shown in FIG. 15.

The sling 24 is attached to the buttstock 26 of the automatic rifle 22, as shown in FIGS. 1, 15, and 16, by the buttstock sling mounting loop assembly 32. The buttstock sling mounting loop assembly 32 includes a stock-encircling strap 158. Preferably the stock-encircling strap 158 is of tightly woven flat webbing of synthetic material such as a non-elastic nylon so that it is not readily stretched.

A first end portion of the stock-encircling strap 158 defines a loop 160 fastened about the middle bars of at least one, and preferably a pair of tribar slides 162, which may be of sheet metal and are held stacked together by the loop 160 extending through a pair of parallel slots between the middle and outer bars of the tribar slides 162. While the pair of tribar slides 162 has shown superior performance, a single tribar slide 162 may also prove to be satisfactory. The loop 160 is preferably formed by stitching through the material of the strap 158. The loop 160 lies along a first face of the pair of tribar slides 162, between them and the buttstock 26.

A stopper plate 164 similar to the stopper plate 134 is fitted onto the strap 158 about three to five inches away from the loop 160, with a bight 166 of the strap 158 extending through the eye of a rear sling swivel 170, where it is held in place by the stopper plate 164. A slide loop, and preferably a pair of rigid, generally rectangular slide loops 168, of a molded high strength plastic material, encircle the doubled portion of the first end of the strap 158 adjacent to the stacked tribar slides 162.

The strap 158 extends from the slide loop or loops 168 downward along the side of the buttstock 26 to the sling swivel 170, and then up and along the opposite side of the buttstock 26 to its top. After passing around the top of the buttstock 26, an upper portion 171 of the strap 158 extends along and into the pair of stacked slides 162 on their first face from the direction opposite the loop 160. The upper portion 171 passes through the tribar slides 162, as seen best in FIG. 16. The tribar slides 162 thus fasten together the first end of the strap 158 and the upper portion 171 of the strap 158. The strap 158 continues from the tribar slide or stacked tribar slides 162 through the slide loops 168, and a D-ring 172 is attached securely to a free second end part 174 of the strap 158, as by a loop sewn into it.

The stopper plate 164 in the bight 166 engaged in the rear sling swivel 170 holds the buttstock attachment loop 32 in a desired position on the buttstock 26. Tension in the free end part 174, when it acts through and on the slide loops 168, tends to tighten the engagement of the tribar slide or slides 162 on the strap 158, as the slide loop or loops 168 are urged along the first end portion of the strap member 158 toward and against the stacked tribar slides 162 by tension in the free end portion 174. The downwardly extending upper portion 171 of the strap 158 is thus pulled through the stacked tribar slides 162, tightening the stock-encircling strap 158 around the buttstock 26. When the free end portion 174 is allowed to become slack, the stacked slides 162 act as a buckle and secure the strap 158 around the buttstock 26, maintaining tension in the upper portion 171. By selectively orienting the bight 166 within the eye of the sling swivel 170, the loop 160 and attached tribar slides 162 can be placed on either side of the buttstock 26, as desired.

The adjustable loop 54 of the rear strap portion 46 of the sling 24 or the adjustable loops 90 of the rear strap portion 88 of the sling 86 can be attached directly to the D-ring 172, by disengaging an end of the strap from the respective tribar slide 52 or 92 and refastening it with the strap extending through the D-ring 172. Alternatively, a stopper assembly 55 can be attached similarly to the rear strap portion 46 or rear strap portion 88 by engaging the rear strap portion through a loop or pair of loops 53 included in the stopper assembly 55.

Sling Mounting Stopper

In one preferred embodiment, the stopper device 55 includes a short strap 182 of suitable webbing material, such as that of the sling straps 46 and 88, attached to the middle bar of a stopper plate in the form of a tribar slide 184 which may be of sheet metal. The strap 182 is also looped through and around one side of the plastic loops 53, attaching the loops 53 to the tribar slide 184, by a length of doubled strap 182 separating it from the loops 53 by a distance 186 of, for example, about 3 inches, although the distance 186 is not critical. Preferably, the loops 53 are held more closely than the tribar slide 184, which preferably has some freedom to move and for the loop of strap material 182 to which it is attached to be flexed and move about the middle bar of the tribar slide 184 to equalize the stresses in the opposite sides of the loop engaging the middle bar.

A flexible securing tab 188 of ribbon-like webbing material, such as a tightly woven non-stretch nylon webbing material about as wide as the strap 182, is fastened as a small loop 190 encircling a side bar 192 of the tribar slide 184. The short end 194 of the webbing material forming one side of the loop 190 extends through the slot between the side bar 192 and the middle bar of the tribar slide. The short end portion 194 lies closely along and in contact with the portion of the strap 182 that passes around the middle bar of the tribar slide 184, when the free end 196 extends through a slot 198 between the middle bar and the side bar opposite the side bar 192, as shown most clearly in FIG. 15. The short end portion 194 thus causes the securing tab 188 to form a considerable hump above the portion of the strap 182 that passes around the middle bar of the tribar slide 184, as shown in FIGS. 5 and 11, when the free end 196 is pulled tight through the slot 198 to the side of the tribar slide 184 from which the strap 182 extends toward the loops 53.

As shown in FIG. 16, when the free end 196 of the securing tab 188 is free from the slot 198, the securing tab 188 may be pulled away from the strap 182 to make the tribar slide 184 lie closely alongside the doubled part of the strap 182 leading toward the loops 53. The combined thickness of the doubled strap 182 and the tribar slide 184 is small enough that the tribar slide 184 and the strap 182 can be pulled through a relatively narrow slot, with the tribar slide 184 in an edgewise orientation, leaving the loops 53 on one side of the material defining the slot while the tribar slide 184 is on the opposite side. Thereafter, when the free end 196 extends through the slot 198 the securing tab 188 is pulled snugly around the middle bar of the tribar slide 184, the combination acts as a stopper plate and is too thick to pass through such a narrow slot. Additionally, when the loop 190 or the free end 196 encounters a surface of the object, such as the D-ring 172, defining the slot or opening through which the strap 182 extends, the tribar slide 184 is urged into a position in which its major plane is oriented transverse to the portion of the strap 182 that extends away from the middle bar of the tribar slide 184, further preventing the stopper from passing back through the slot or opening in the opposite direction.

Such a stopper assembly 55 could be used at either or both of the ends 38 and 42 of the sling 24 or the ends 87 and 104 of the sling 86, to attach the sling 24 or 86 to a front attachment loop 40, attachment device 144, or a buttstock sling mounting loop 32.

Figure 17:
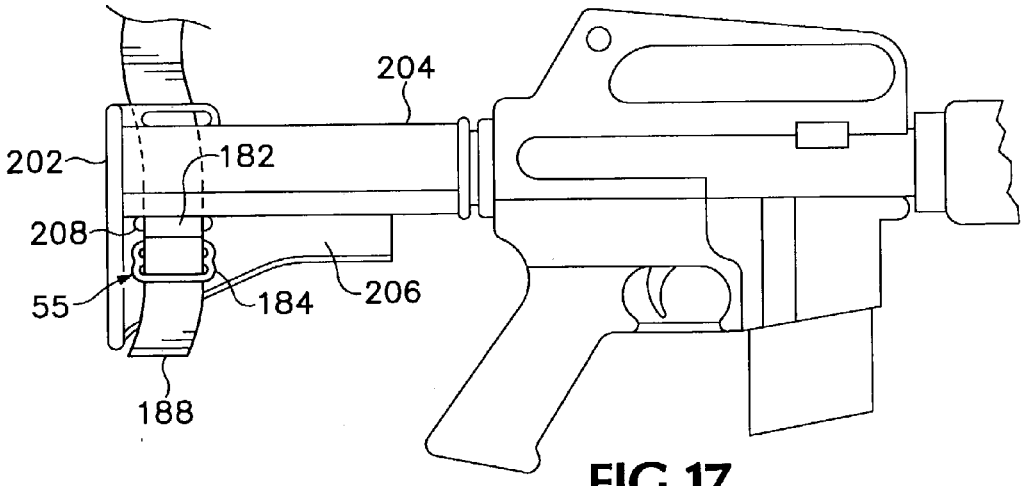
FIG. 17 is a side view of a military carbine, showing the attachment of the rear end of a sling such as that shown in FIGS. 1–5 to the buttstock of the carbine.

The stopper assembly 55 is particularly useful, as shown in FIG. 17, for attaching a sling 24 to the buttstock 202 of a military carbine. The buttstock 202, instead of having the traditional shape of a wooden buttstock, includes a tubular portion 204 and a flat web 206 extending downward from the tubular portion 204 and defining a slot 208, in which a stopper assembly 55 is engaged to attach a sling 24 to the carbine.

Alternative Rear End Attachment

An alternative mounting loop assembly 210 for fastening a sling 24 or the like to a buttstock 26 of a shoulder weapon includes a stock-encircling strap 212, preferably of closely woven fabric such as a strong non-stretch nylon webbing, whose opposite ends define respective loops 214 and 216 facing each other and separated by a small distance 218 when the mounting loop assembly is in place on a buttstock 26 of a shoulder weapon. A small bight 220 of the strap 212 extends through the sling swivel 170, where it is held in place by a slotted stopper plate 222 mounted on the strap 212.

Figure 18:
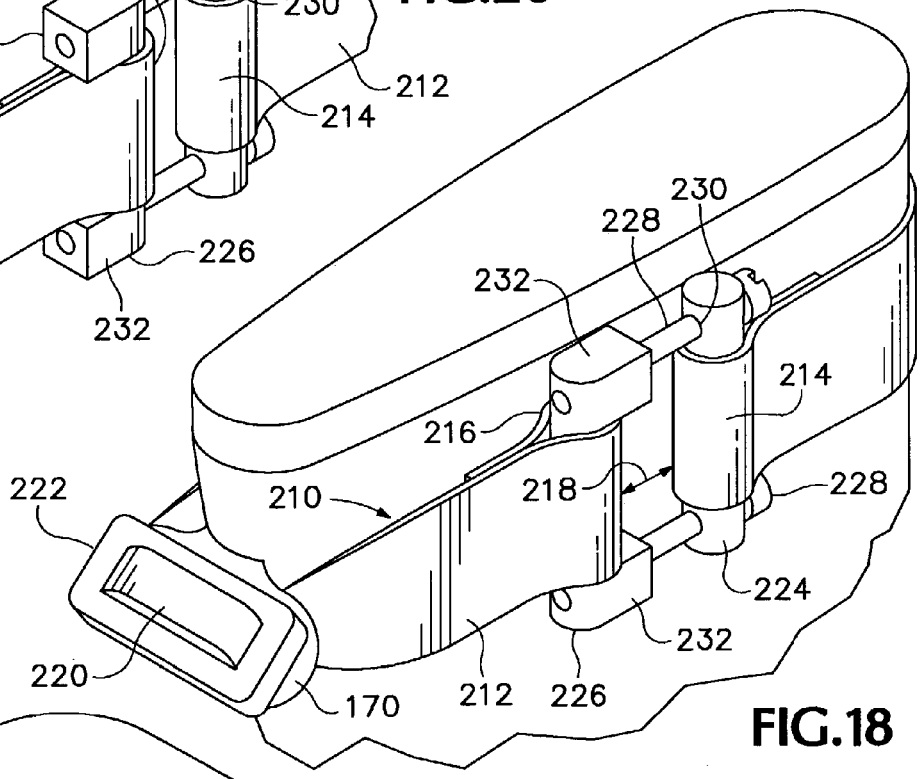
FIG. 18 is an isometric view of the rear end of a buttstock of a military rifle with a different sling mounting loop assembly mounted on the buttstock and engaged with the rear sling swivel of the weapon, as seen from the lower right rear of the buttstock.
Figure 19:
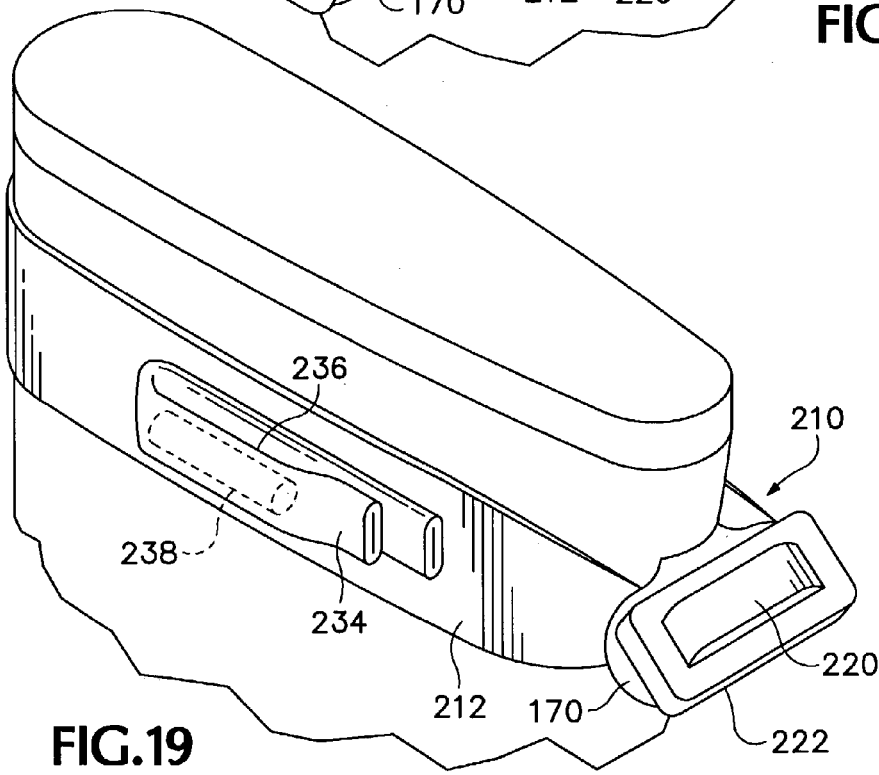
FIG. 19 is an isometric view of the portion of a buttstock and the sling mounting loop assembly shown in FIG. 18, as seen from the lower left rear of the buttstock.

A fastener assembly interconnecting the loops 214 and 216 adjustably with each other includes a first end piece in the form of a bar 224 extending through the first loop 214 and a second piece in the form of a generally U-shaped member 226 engaged in the second loop 216. A pair of screws 228 are engaged rotatably in respective through-bores 230 defined near the ends of the bar 224 and parallel with each other. The screws 228 are engaged in mating threads in the leg portions 232 of the U-shaped member 226. With the leg portion 232 oriented as shown in FIG. 18, facing toward the bar 224, the threads of the screws 228 are received within the threads in the facing leg portions 232, and the screws 228 can be adjusted to tighten the strap 212 around the buttstock 16. The legs 232 cover the threads and the ends of the screws 228 so that they are not openly exposed to catch on the surroundings of a weapon on which the mounting loop assembly 210 is used. The bar 224 and the U-shaped member 226 are preferably of a strong plastic material in order to be quieter than metal and not be subject to corrosion.

The mounting loop assembly can be attached so that the fastener assembly can be placed on either side of the buttstock 26 by rotation of the bight 220 within the eye of the sling swivel 170, and the position of the strap 212 in the stopper plate 222 can be adjusted as necessary to place the fastening assembly where desired.

Figure 20:
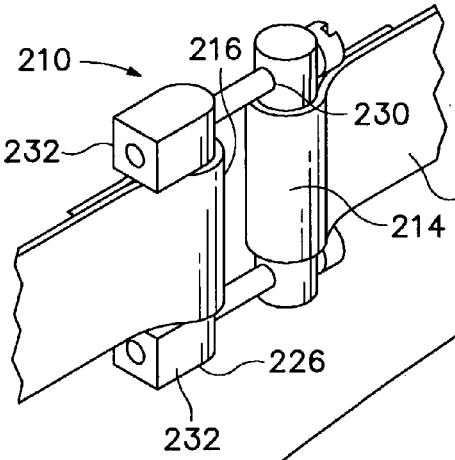
FIG. 20 is a view of the strap fastening arrangement of the sling mounting loop assembly in FIG. 18, fastened in an alternative arrangement.

On the opposite side of the buttstock 26, a sling strap receptacle 234 is fastened to the strap 212. The receptacle 234 may be in the form of a length of tubular webbing doubled over along itself and forming a slot 236 to receive a strap or to engage a stopper 55 described above. Preferably, a small rod 238 is retained within an outer leg of the tubular webbing material to provide a stable, stiffened shoulder to receive a strap or the stopper plate 184 of a stopper 55. The rod 238 may, for example, be of a hard plastic material.

Where the distance 218 between the loops 214 and 218 in opposite ends of the sling mounting loop assembly 210 is short, exposing the ends of the screws 228, the orientation of the U-shaped member 226 may be reversed, and the leg portions 232 of the U-shaped member 226 may be directed away from the bar 224 engaged in the strap loop 214, as shown in FIG. 20, to provide a protective covering for the threaded ends of the screws 228 when they are adjusted to tighten the strap 212 adequately around a buttstock.

The terms and expressions that have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims that follow.

The invention claimed is:

1. A sling for a shoulder weapon, comprising:

(a) an elongate rear strap portion;

(b) an elongate quickly extendible front strap portion interconnected with said rear strap portion, said front strap portion having a fixed first end, a main portion extending from said fixed first end, and an extension portion extending from said main portion, said extension portion having a traveling end;

(c) a quick release plate fastened to said traveling end of said extension portion, said quick release plate defining a slot and said front strap portion extending through said slot, and said quick release plate being a non-metallic three bar slide;

(d) an engagement member attached to said main portion, said engagement member having a flexible front flap portion extending alongside said main portion and toward said fixed first end of said front strap portion, said engagement member preventing said quick release plate from moving away from said fixed first end past said engagement member when said quick release plate is allowed to lie alongside and generally aligned with said main portion, and wherein said front flap portion flexes and allows said quick release plate to move past said engagement member and away from said fixed first end when said quick release plate is held generally perpendicular to said main portion.

2. The sling of claim 1 wherein said engagement member has a rear portion extending closely alongside and securely fastened to said main portion.

3. The sling of claim 1 wherein said fixed first end of said front strap portion is located at a front end of said sling and said quick release plate is selectively slidable along said main portion, and wherein said engagement member is attached to said main portion near said fixed first end thereof.

4. The sling of claim 3 wherein said elongate rear strap portion has attached thereto a front end fitting defining a strap slide aperture, and wherein said front strap portion extends slidably through said strap slide aperture.

5. The sling of claim 1 wherein said front strap portion extends slidably through a strap slide aperture and said extension portion extends back alongside a portion of said front strap portion toward said fixed first end on a first side of said front strap portion, and wherein said engagement member is located on an opposite second side of said front strap portion.

6. The sling of claim 1 wherein said fixed first end of said front strap portion is interconnected with a front end of said rear strap portion and said quick release plate is selectively slidable along said main portion, and wherein said engagement member is attached to said main strap portion near said fixed first end thereof.

7. A sling for a shoulder weapon, comprising:

(a) an elongate rear strap portion;

(b) an elongate quickly extendible front strap portion interconnected with said rear strap portion, said front strap portion having a fixed first end, a main portion extending from said fixed first end, and an extension portion extending from said main portion, said extension portion having a traveling end;

(c) a quick release plate fastened to said traveling end of said extension portion, said quick release plate defining a slot and said front strap portion extending through said slot, wherein said quick release plate is a tribar slide defining a pair of parallel slots and said first end of said securing tab forms a loop through a first of said parallel slots and around an outer bar of said tribar slide, and wherein said securing tab extends removably through the other of said pair of parallel slots; and (d) an engagement member attached to said main portion, said engagement member having a flexible front flap portion extending alongside said main portion and toward said fixed first end of said front strap portion, said engagement member preventing said quick release plate from moving away from said fixed first end past said engagement member when said quick release plate is allowed to lie alongside and generally aligned with said main portion, and wherein said front flap portion flexes and allows said quick release plate to move past said engagement member and away from said fixed first end when said quick release plate is held generally perpendicular to said main portion.

* * * * *